US005440377A

United States Patent [19]

Izawa et al.

[11] Patent Number: 5,440,377

[45] Date of Patent: Aug. 8, 1995

[54] APPARATUS FOR CONTROLLING SPEED OF A DEVELOPING ROLLER AS IT ENGAGES A PHOTORECEPTOR

[75] Inventors: Tadashi Izawa; Ken Nonaka; Masaaki Ikeda, all of Hachioji, Japan

[73] Assignee: Konica Corporation, Japan

[21] Appl. No.: 138,127

[22] Filed: Oct. 15, 1993

[30] Foreign Application Priority Data

Nov. 4, 1992 [JP] Japan ..... 4-295202

[51] Int. Cl.[6] ..... G03G 15/06

[52] U.S. Cl. ..... 355/245; 355/200; 355/211

[58] Field of Search ..... 355/200, 210, 211, 245, 355/259, 326, 327; 118/645, 653, 656

[56] References Cited

U.S. PATENT DOCUMENTS

| | | | |
|---|---|---|---|
| 4,878,088 | 10/1989 | Nakanishi et al. | 355/259 X |
| 4,939,547 | 7/1990 | Miyaji et al. | 355/245 |
| 5,089,849 | 2/1992 | Hiraoka | 355/211 |
| 5,202,739 | 4/1993 | Hatakeyama et al. | 355/245 X |
| 5,283,619 | 2/1994 | Nomura et al. | 355/245 X |
| 5,291,242 | 3/1994 | Takano | 355/245 X |
| 5,293,199 | 3/1994 | Saito et al. | 355/245 X |
| 5,294,967 | 3/1994 | Munakata et al. | 355/245 X |
| 5,311,260 | 6/5199 | Nakakuma et al. | 355/245 |

FOREIGN PATENT DOCUMENTS

| | | | |
|---|---|---|---|
| 59-224873 | 12/1984 | Japan | 355/211 |
| 62-86370 | 4/1987 | Japan | 355/211 |
| 62-245271 | 10/1987 | Japan | 355/211 |
| 63-292173 | 11/1988 | Japan | 355/211 |
| 4-350864 | 12/1992 | Japan | 355/211 |

*Primary Examiner*—William J. Royer

*Attorney, Agent, or Firm*—Jordan B. Bierman; Bierman and Muserlian

[57] ABSTRACT

A developing device is provided with a clutch to engage or disengage between a sleeve and a driving motor. When the developing device is used for development, spacing rollers on the sleeve are brought in contact with a photoreceptor drum and the speed of the driving motor is reduced to a lower speed, thereafter the clutch is operated to engage the sleeve and the driving motor and the speed of the driving motor is increased to a rated speed.

4 Claims, 5 Drawing Sheets

APPARATUS FOR CONTROLLING SPEED OF A DEVELOPING ROLLER AS IT ENGAGES A PHOTORECEPTOR

BACKGROUND OF THE INVENTION

The present invention relates to an apparatus wherein when an image formed on an image carrier is developed by a plurality of developing units, a developing sleeve provided in each developing unit is controlled not to start rotating promptly in the course of development so that a photoreceptor drum for image forming may not be adversely affected.

An image forming apparatus has hitherto been provided at least with a charging unit, an exposure unit employing an ordinary light source or a laser beam, and a developing unit only for black images or a plurality of developing units, in the case of color copying, all arranged in succession around a photoreceptor drum which is an image carrier. When forming an image on the photoreceptor drum, the charging unit charges the entire surface of the photoreceptor drum with electricity first and the exposure unit exposes the surface of the photoreceptor drum depending on input signals from a document or from a computer, thus, there is formed a latent image corresponding to the signals coming from the document or the computer. The latent image is then developed by the developing unit. In the case of the color copies in particular, there are provided a plurality of developing units each of which contains different color toner, and color developing is carried out in a way wherein only the developing unit that takes part in developing among other developing units is brought into contact with the surface of the photoreceptor drum for developing operation. The developing unit is generally provided with a developing rotary sleeve which is rotated by a driving means at high speed (for example, 300–350 rpm depending on colors) in the course of developing so that color toner may be conveyed to the latent image to cover all kinds of images for excellent developing.

In the situation that the driving means is started to rotate the developing rotary sleeve for developing a latent image formed on the photoreceptor drum as described above, the diameter of the photoreceptor drum can not be so large due to the general restriction in terms of total dimensions and a cost of an apparatus. Even in the case of a small document size used normally, therefore, the exposure unit is still working for exposure even when a latent image formed on the photoreceptor drum arrives at the developing unit and the developing rotary sleeve starts rotating. In a method of exposure, a portion charged with electricity on the surface of the photoreceptor drum is then subjected to exposure in succession generally. When a laser beam is used for exposure, in particular, scanning for a small width from side to side which is synchronized with a rotation of the photoreceptor drum is conducted for exposure. When a developing rotary sleeve of a developing unit is started under the condition mentioned above, the higher the speed of rotation of the sleeve is, the greater the shock in the start is, and the surface of the photoreceptor drum is naturally affected by the shock. The reason for this lies in that the thickness of a developer layer located on a developing rotary sleeve to be conveyed in the recent developing unit is thin, the distance between the developing rotary sleeve and the surface of a photoreceptor drum (hereinafter referred to as DSD) is extremely small, and a DSD width which is as small as 0.5 mm is required to be maintained accurately. As a means for forming the DSD width, there are provided rollers at both sides of the developing rotary sleeve so that the rollers may be in contact with the surface of the photoreceptor drum to maintain the accurate DSD width. Since the rollers are provided on a coaxial basis with the developing rotary sleeve, the shock in the start is transmitted to the photoreceptor drum through the rollers and accurate rotation of the photoreceptor drum is affected adversely temporarily. Therefore, a jittering problem is caused, at the start of operation, on the latent image forming surface subjected to exposure, resulting in a defective developed image. When forming a color image by superimposing different plural colors, in particular, the jittering problem is caused for each developing unit, making it impossible to obtain color images, which is a disadvantage.

SUMMARY OF THE INVENTION

In an image forming apparatus provided with a developing means comprising an image carrier, a charging means that applies electric charges on the image carrier, an exposure means, a plurality of developing means for developing a latent image formed by the exposure means and a driving means for driving the plural developing means wherein there are provided a developing rotary sleeve provided in each of the plural developing means, a driving means that drives the developing rotary sleeve and a clutch provided between the developing rotary sleeve and the driving means, the invention has solved the problem mentioned above by engaging the clutch or the condition that the driving means is stopped or so rotated at a lowered speed of rotation of the driving means when the developing rotary sleeve is driven by the driving means.

DETAILED DESCRIPTION OF THE PREFERRED EMBODIMENT

Figure 1:
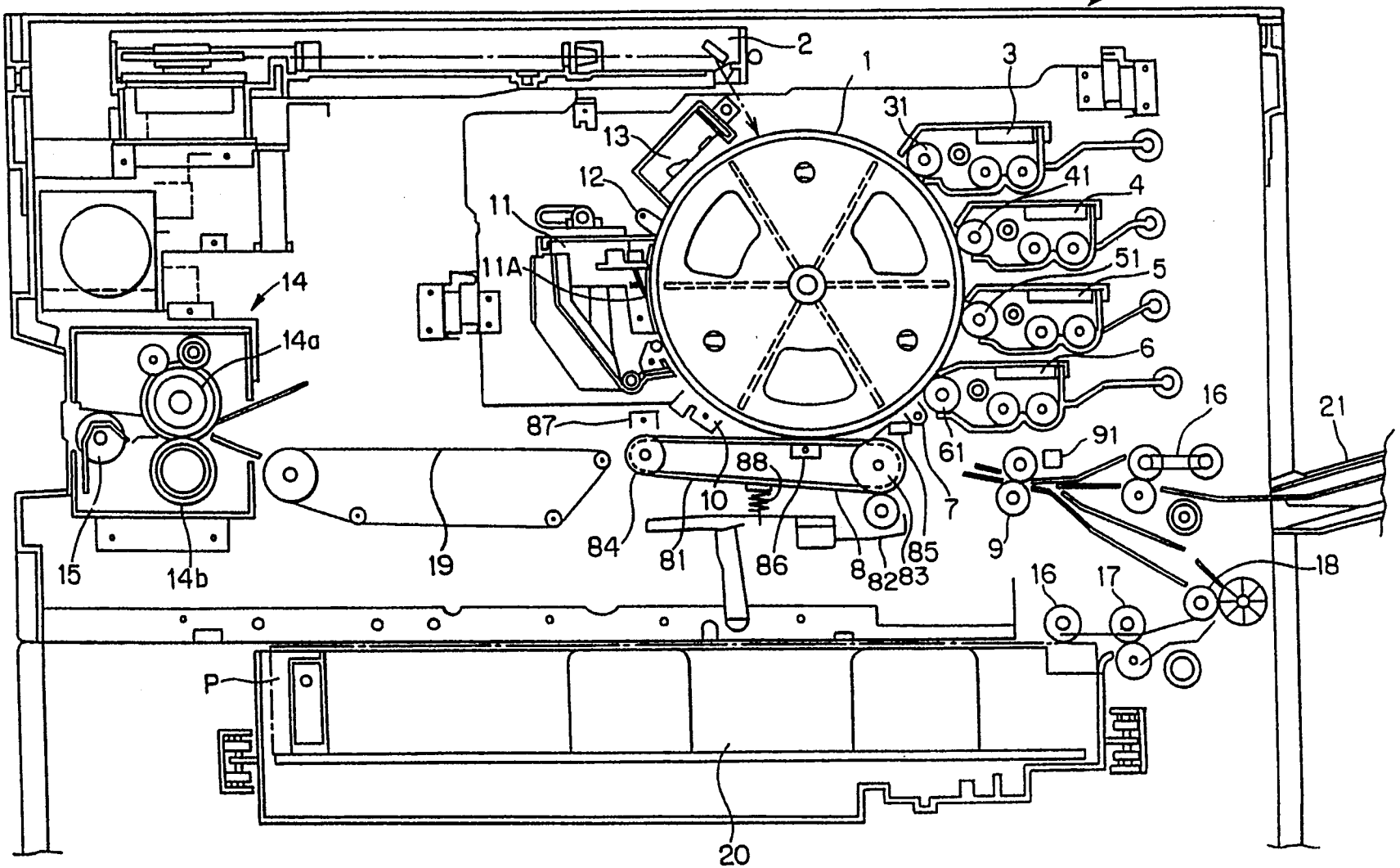
FIG. 1 is a structural diagram showing the main portion of an example of a color image forming apparatus of the invention.

Next, an image forming apparatus wherein the invention is applied will be explained, referring to the drawings.

FIG. 1 is a drawing showing the structure of the main portion of an example of an image forming apparatus of the invention.

The present example is represented by color copying machine A equipped with a laser-writing device of a non-contact developing type copying with 4 colors of yellow, cyan, magenta and black (hereinafter referred to as Y, C, M, and Bk, respectively).

How the main body of the color copying machine is structured basically and how it works basically in an ordinary mode will be explained.

Prior to exposure by means of laser-writing unit 2, photoreceptor drum 1 that is an image carrier is neutralized by light of PCL 12 and then is subjected to charging by means of charging unit 13 so that the entire surface of the photoreceptor drum may indicate uniform predetermined potential. The charging unit 13 is a scorotron charger, grid voltage is −550 V and charging voltage of the photoreceptor is −600 V, and these conditions are used in an ordinary mode.

On photoreceptor drum 1 subjected to primary charging, there are formed latent images in succession by laser-writing unit 2, and these latent images are developed successively by non-contact reversal developing units 3, 4, 5 and 6 each representing Y, M, C and Bk. In the case of full-color copying, the photoreceptor drum 1 makes one turn for the development in each color, making four turns in total, thus a plurality of toner images each having different color are formed and superposed on the photoreceptor drum 1. The numeral 7 is a pre-transfer exposure lamp which improves transfer efficiency.

The numeral 8 represents a transfer-belt unit which is a transfer/conveyance unit of a belt type, and 81 is a transfer belt having thereon electric charges and attracts recording sheet P. The numerals 83 and 84 represent holding rollers which are provided at both ends of supporting member 82 and support, stretch and rotate the transfer belt 81, and 85 is a sheet charger that causes the recording sheet P by means of a conductive brush to discharge electricity so that the recording sheet P may be attracted by static electricity force to the transfer belt 81. The numeral 86 is a transfer electrode which is a charger for transferring toner images from photoreceptor drum 1 to the recording sheet P. Owing to the arrangement mentioned above, the recording sheet P can be attracted firmly to the transfer belt 81 to be conveyed surely, resulting in excellent transfer efficiency and separation efficiency at the transfer section.

The transfer belt unit 8 mentioned above is a preferable unit for a color image forming apparatus wherein plural toner images each having different color are formed and superposed on photoreceptor drum 1 and then are transferred onto recording sheet P simultaneously. In the color copying machine A mentioned above, plural developing units are provided around photoreceptor drum 1 for superposing plural toner images on the photoreceptor drum 1, which makes the drum diameter large. Accordingly, an electrostatic transfer/separation system of a conventional type can not offer sufficient separation efficiency, and thereby more positive separation capacity is needed. In the system wherein toner images are superposed, an amount of adhering toner is large, and a large amount of electric charges for transfer is required accordingly and a greater capacity for holding electric charges for transfer is needed. For the reasons mentioned above, the transfer belt unit is used.

The holding rollers 83 and 84 of the transfer belt unit 8 are rollers made of conductive materials, and holding roller 83 that is positioned at the upstream side is grounded or is electrified to a predetermined voltage that is closer to the grounded condition. The supporting member 82 shares the axis of holding roller 84 as a fixed shaft, and is normally urged by elastic member 88 so that the holding roller 83 may be located at a lower position, and transfer belt 81 is away from the circumferential surface of the photoreceptor drum 1.

In the course of transferring, the supporting member 82 is rotated clockwise against the force of the elastic member mentioned above by means of a solenoid, for example, that is actuated through the control of the control unit for the main body of the apparatus, and the transfer belt 81 is brought into pressure contact with the photoreceptor drum under the predetermined pressure.

In the transfer belt unit 8, transfer belt 81 is driven concurrently with the start of the copying operation. It comes into pressure contact with photoreceptor drum 1, and the bias voltage for the pre-transfer recording sheet P to be attracted is impressed by sheet charger 85, both simultaneously with the start of rotation of second sheet-feeding roller 9 located at the upstream side of the transfer section. The leading edge of the recording sheet P is fed onto the transfer belt 81 by means of the second sheet-feeding roller 9. The recording sheet P is attracted to the transfer belt 81 to be conveyed to the transfer section. When the leading edge of the recording sheet P has just passed the transfer section by a fixed length (for example, 5–7 mm), a constant-voltage power supply for the transfer electrode 86 is turned on for starting the transfer of toner images. Upon the completion of the transfer, the transfer belt 81 is separated from the photoreceptor drum 1 by the elastic member mentioned above.

Recording sheet P loaded on sheet-feeding tray 20 is fed out by feed-out roller 16 one sheet by one sheet as shown in FIG. 1, and is conveyed up to the second sheet-feeding roller 9 through the first sheet-feeding roller 17 and intermediate conveyance roller 18. When the leading edge of the recording sheet P touches the second sheet-feeding roller 9, sheet sensor 91 senses the arrival of the recording sheet P and makes detection signals. The signals stop the first sheet-feeding roller 17 and intermediate conveyance roller 18 and thereby the recording sheet P waits the transfer of toner images thereon while it keeps touching the second sheet-feeding roller 9. Owing to the foregoing, the recording sheet P is fed constantly at the same linear speed and touches the second sheet-feeding roller 9 to be on standby, and the recording sheet P is conveyed by synchronized rotation of the second sheet-feeding roller 9 to the transfer section without causing any slip of timing, synchronizing surely with the movement of toner images on the photoreceptor drum 1.

Incidentally, the numeral 21 represents a sheet tray for manual feeding, and a recording sheet fed manually is conveyed to the second sheet-feeding roller 9 constantly at the same linear speed by feed-out roller 16, similarly to the foregoing, and the recording sheet touches the second sheet-feeding roller 9 to be on standby for transferring.

When the recording sheet P passes through the upper portion of transfer electrode 86, multi-color toner images each having different color formed and superposed are transferred simultaneously.

The recording sheet P onto which the multi-color toner images have been transferred is neutralized by neutralizer 87, and then is conveyed by conveyance belt 19 to fixing unit 14 to be subjected to a fixing process. A pair of heat rollers **14*a* and 14*b* are used for the fixing process. A heater is built in the heat roller 14*a***, and fixing temperature is controlled by switching the operation time of the heater. The temperature control includes two ways: one is to control by switching depending only upon the mode of recording sheet without variation and the other is to control on a negative feedback basis based on the results of measurement of ambient temperature detected by an unillustrated temperature sensor.

After the fixing process, the recording sheet P is conveyed to a copy tray outside for ejection through sheet-ejection roller 15.

In the course of the exposure and developing process mentioned above, the transfer belt 81 and cleaning blade 11A of cleaning unit 11 are away from the photoreceptor drum to be in non-contact state, and when the photoreceptor drum 1 enters its fifth turn, the transfer belt unit 8 and the cleaning unit 11 are brought into pressure contact with the photoreceptor drum. The reason why the transfer belt and others are brought into pressure contact after multi-color toner images have been formed completely is to avoid that multi-color toner images are disturbed on the half way of image forming. Charge elimination means 10 is used to eliminate the charge on the residual toner remaining on the photoreceptor after the multi-color toner image has been transferred to the recording sheet.

An unillustrated control unit is provided with a fixing temperature control means, a process speed control means, a transfer/cleaning pressure contact control means, a transfer current switching means and others, and it controls totally switching of process speed, switching of transfer current and others.

Further, as a block of driving system, photoreceptor drum 1, developing units 3–6, first sheet-feeding roller 17, intermediate conveyance roller 18, second sheet-feeding roller 9, conveyance belt 19 and a pair of heat rollers 14*a* and 14*b* of fixing unit 14 are driven through, for example, the PLL control of D.C. motor. Among the above items, the first sheet-feeding roller 17, for example, is driven when an electromagnetic clutch is turned on by the command of the control unit, and the developing units 3–6, the second sheet-feeding roller 9 and the intermediate conveyance roller 18 are driven when an electromagnetic clutch is turned on by the command of the control unit.

What has been explained above shows the total structure of an image forming apparatus wherein a color image is formed.

Figure 2:
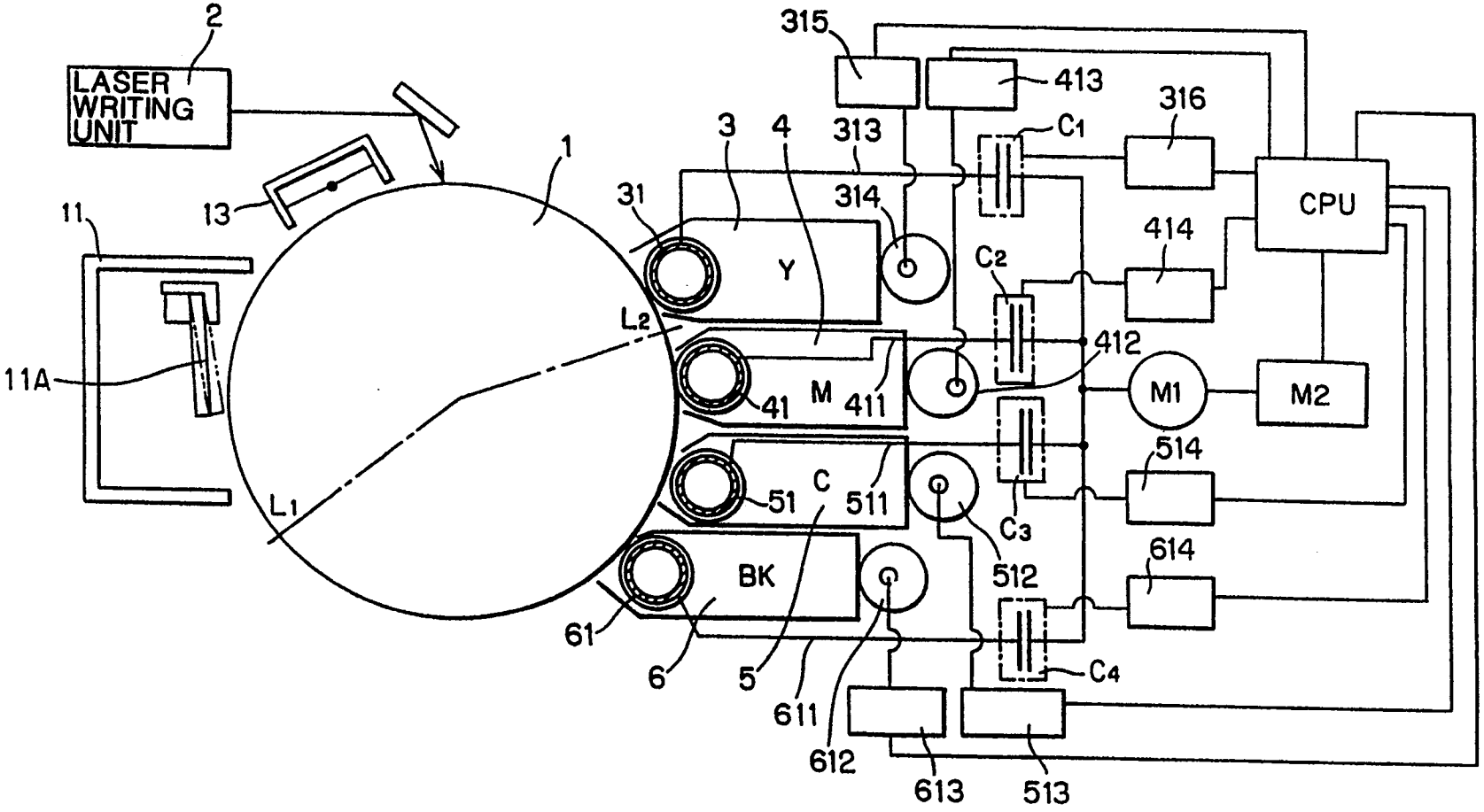
FIG. 2 is a structural diagram showing how a photoreceptor drum and developing units are controlled.
Figure 3:
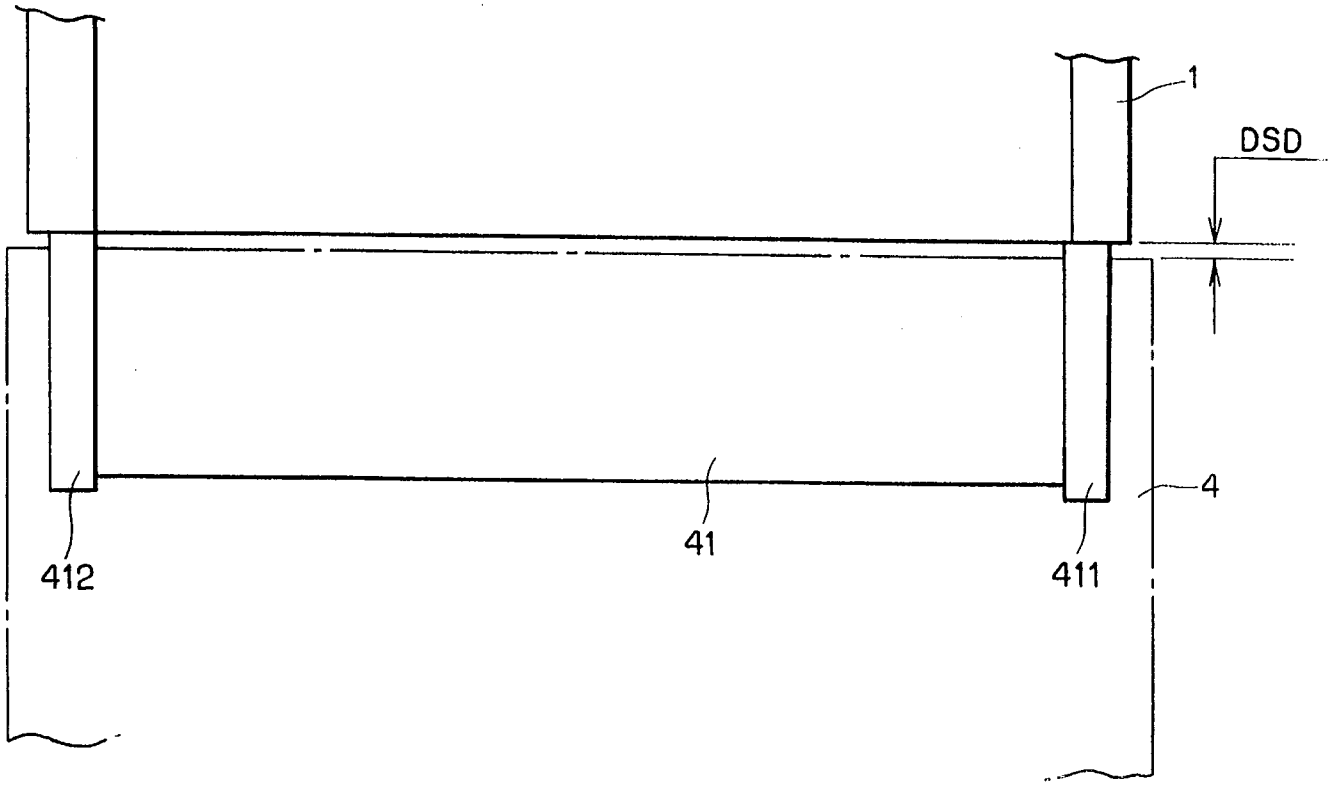
FIG. 3 is a structural diagram showing the relation between a photoreceptor drum and a developing rotary sleeve as well as its rollers.

An example of the invention is shown in FIG. 2. Similarly to FIG. 1 above, charging unit 13 and laser-writing unit 2 are provided for photoreceptor drum 1. There are further provided successively developing units 3, 4, 5 and 6 corresponding respectively to Y, M, C and Bk around the circumferential surface of the photoreceptor drum 1. The developing units 3, 4, 5 and 6 are respectively provided, at their openings, with developing rotary sleeves 31, 41, 51 and 61. As shown in FIG. 3, rollers 411 and 412 which are for keeping a DSD clearance are further provided rotatably at both ends of the developing rotary sleeve 41.

Rollers identical to those shown in FIG. 3 are also provided rotatably at both ends of each of the other developing rotary sleeves 31, 51 and 61 illustrated in FIG. 2. The developing rotary sleeves 31, 41, 51 and 61 are linked with driving motor $M_1$ by means of linkage means 313, 411, 511 and 611 through clutches $C_1$, $C_2$, $C_3$ and $C_4$. As the linkage means, gears, timing belts, chains and others may be preferably used. On non-developing sides of the developing units 3, 4, 5 and 6, there are respectively provided cams 314, 412, 512 and 612 which are connected to CPU for control use through swing-control means 315, 413, 513 and 613 which swing the cams 314, 412, 512 and 612 respectively. As a swinging means for the cam, a small-sized motor, a stepping motor or the like may be used. The clutches $C_1$, $C_2$, $C_3$ and $C_4$ are also connected to the CPU for control use through operation-control means 316, 414, 514 and 614, and the driving motor $M_1$ is connected to the CPU for control use through operation-control means $M_2$.

The invention is structured as described above, and an unillustrated copy start switch is turned on first for the start of copying, and an image is recorded on recording sheet P according to the procedures illustrated in FIG. 1. In the invention, as shown in FIG. 2, the surface of photoreceptor drum 1 is charged successively by charging unit 13, and a latent image is formed by laser-writing unit 2 on the surface of the photoreceptor drum 1 based on a document or inputted signals. The rotation of the photoreceptor drum 1 is controlled by CPU for control use through the use of a stepping motor and a location of the latent image is discriminated by the CPU for control use through a program. When developing with developing unit 4 in FIG. 2, cam 412 is swung by the CPU for control use through swing-control means 413, the developing unit 4 is moved toward the photoreceptor drum 1 so that rollers 411 and 412 may be brought into contact with the surface of the photoreceptor drum 1 as shown in FIG. 3, and a predetermined DSD width is set between the surface of the photoreceptor drum 1 and developing rotary sleeve 41. Until the position of a latent image on the photoreceptor drum 1 arrives at a position of $L_2$, clutch $C_2$ is disengaged by the CPU for control use through operation-control means 414, but driving motor $M_1$ has been started by operation-control means $M_2$. When the clutch $C_2$ is caused to engage by the CPU for control use through operation-control means 414 for rotating developing rotary sleeve 41 of the developing unit 4, driving motor $M_1$ is either stopped or decelerated by the CPU for control use through the operation-control means $M_2$. Upon completion of engagement of the clutch $C_2$, the CPU for control use gives signals for starting the driving motor $M_1$ to the operation-control means $M_2$, thus, the developing rotary sleeve 41 is caused to start rotating by the driving motor $M_1$ through linkage means 411. Thus, the rotation of the developing rotary sleeve 41 is either stopped or decelerated when the clutch $C_2$ is engaged and thereby, the shock against the photoreceptor drum 1 caused by the start of rollers 411 and 412 shown in FIG. 3 can be avoided. Therefore, no image disturbance takes place on a latent image up to $L_1$ formed through laser-writing on the photoreceptor drum 1. Incidentally, other developing units 3, 5 and 6 have been moved away from the photoreceptor drum 1 by means of cams 314, 512 and 612, and rollers provided at both ends of developing rotary sleeves 31, 51 and 61 respectively are away from the photoreceptor drum 1 accordingly. When other developing units 3, 5 and 6 develop after completion of development by unit 4 conducted by the developing rotary sleeve 41, operations similar to those mentioned above are conducted for development.

Figure 4:
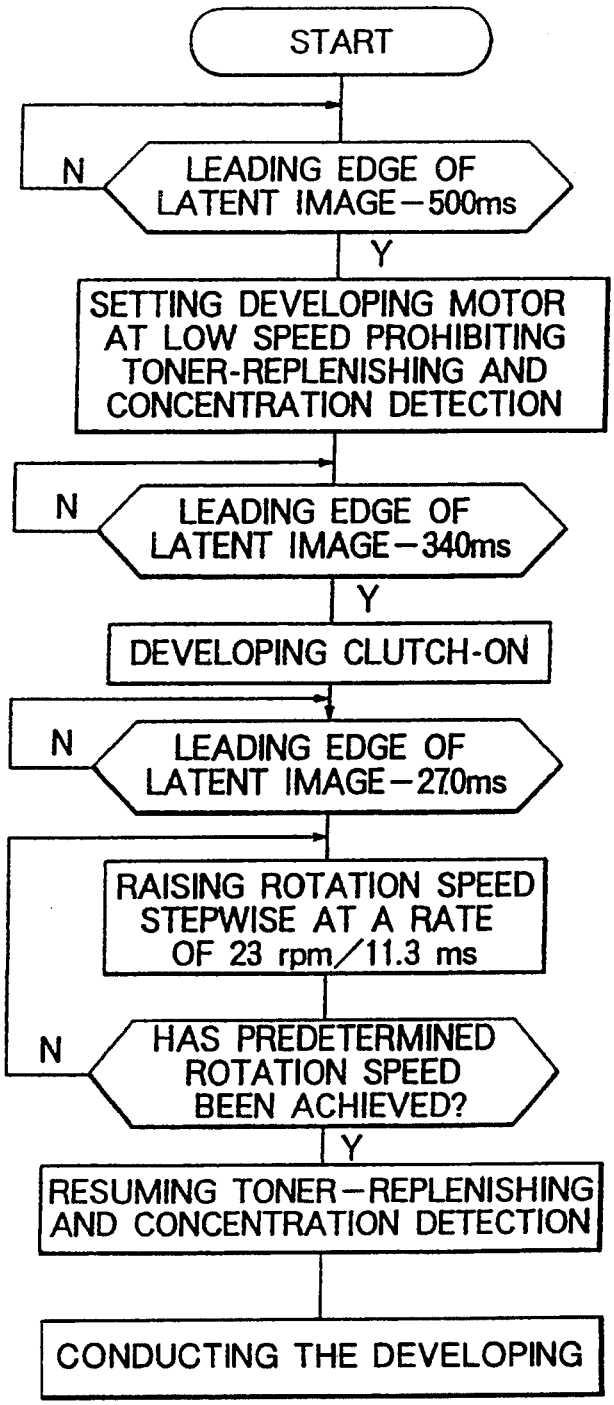
FIG. 4 is a flowchart.
Figure 5:
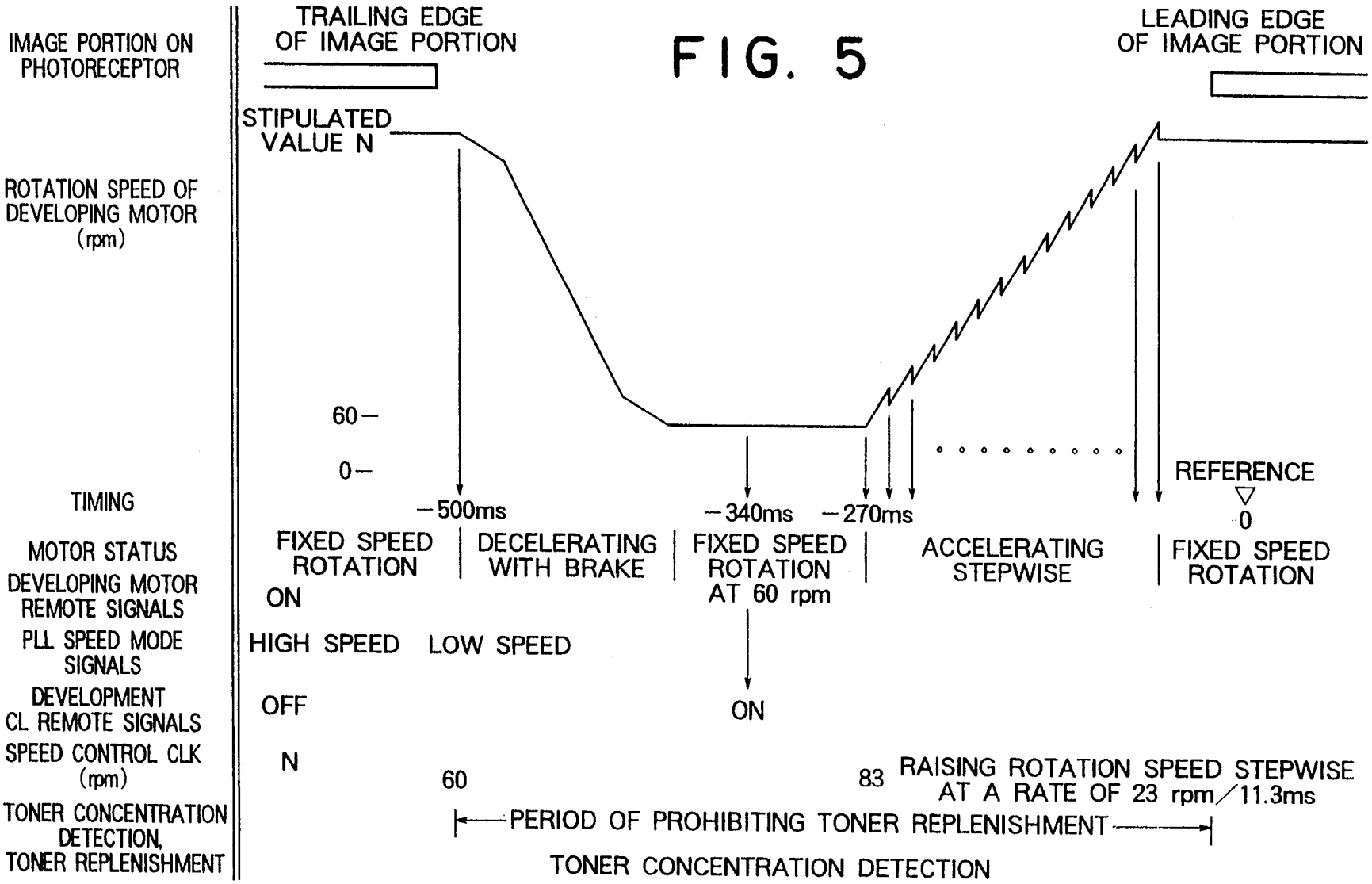
FIG. 5 is a timing chart.

An example of the actual control is shown on a flowchart in FIG. 4 and on a timing chart in FIG. 5.

Upon completion of development for Y (yellow) conducted by developing unit 3 for an image portion, clutch $C_1$ of the developing unit 3 is turned off for "disengagement". The setting of the driving motor to a lowered speed is conducted earlier by −500 ms than the timing for the reference position on the photoreceptor where a latent image forming process for the succeeding color of magenta is started to arrive at a predetermined position.

By this setting to a lowered speed a brake is applied on the developing motor so that the speed of the driving motor is reduced lower than a given speed N and the driving motor runs at the speed of 60 rpm, and clutch $C_2$ of developing unit 4 for magenta development is turned on for "engagement" at the timing earlier by −340 ms than the timing of the reference position. Due to the clutch "engagement" in the course of an operation at a lower speed, occurrence of a shock can be avoided, and image disturbance caused by rotation irregularity of the photoreceptor can be prevented accordingly. Being accelerated gradually from the point of −270 ms, the speed of the driving motor is returned to the predetermined speed of rotation N by the timing of the reference position. In the case of accelerating the speed, when the speed is accelerated promptly up to the predetermined speed of rotation, there is a fear that the image disturbance similar to that caused by clutch "ON" in the course of high speed operation may take place due to an overshoot effect. Therefore, it is preferable to accelerate gradually. After establishment to the predetermined speed of rotation, development is conducted, and when the developing agent is of a two-component type consisting of carrier and toner, detection of toner concentration and toner replenishment are conducted. When the driving motor is not set to the predetermined speed of rotation, neither detection of toner concentration nor toner replenishment is conducted in the present example. The reason for the above is that when the speed of rotation of the driving motor is lower than the predetermined value, stirring speed in the developing unit is also reduced, and thereby toner replenishment causes toner packing. Further, since the toner concentration output shows a sinusoidal output with a cycle of the speed of rotation for stirring, the peak value within a certain period of time is defined as an effective value. Since the cycle itself fluctuates in the case of an operation at a lower speed, there is a fear that accurate toner concentration can not be detected. This is also the reason why neither detection of toner concentration nor toner replenishment is conducted.

Incidentally, in the embodiments mentioned above, each of the developing devices is moved separately by a correponding cam so that the rollers 411,412 of each of the developing devices are brought in contact with the photoreceptor drum 1 only when the developing devices are used for development of a corresponding color. Therefore, when the developing devices are not used, the rollers 411,412 of each of the developing devices are kept to be spaced from the photoreceptor drum 1.

However, the invention is not limited to these embodiments and can be applied to a following embodiment in which the rollers 411,412 of each of the developing devices are kept to be brought in contact with the photoreceptor drum 1 even when the developing devices are not used for development. Instead, when the developing devices are not used, the corresponding clutches are made "OFF" to disengage the sleeve from the driving motor and the developing bias voltage is not applied so that the development is not conducted.

As stated above, in the present invention where a latent image on photoreceptor drum 1 is developed by developing units 3, 4, 5 and 6 in succession, DSD-determining rollers provided on the developing units are made to come into contact. Further, when a clutch between a driving motor for rotating a developing rotary sleeve and the developing rotary sleeve is caused to engage, the driving motor is either stopped or caused to run at a lower speed so that an influence of the rollers caused by the contact between the surface of the photoreceptor drum and the rollers may be avoided and especially jitter may be prevented from occurring on a latent image when the latent image is formed on the photoreceptor, drum, thus excellent images may be offered constantly.

What is claimed is:

1. An apparatus for forming a toner image around a rotatable endless photoreceptor, comprising:

a charger for providing a surface of the photoreceptor with an electric charge;

an exposure device for exposing the photoreceptor with an image light so as to form a latent image;

a plurality of developing devices differing in color to develop the latent image into a color toner image, each of the developing devices including a cylindrical sleeve, a spacing roller provided coaxially on the sleeve, wherein when a latent image is developed, the spacing roller is brought in contact with the photoreceptor so that a given distance is provided between the sleeve and the photoreceptor and the sleeve is rotated at a rated speed by a driving motor, a clutch to engage or disengage the sleeve and the driving motor;

a controller to control the clutch and the driving motor so that when the clutch engages the sleeve and the driving motor, the driving motor is stopped or rotated at a speed lower than the rated speed.

2. The apparatus of claim 1, wherein an image region in which a toner image is formed is designated on the photoreceptor, and the clutch engages the sleeve and the driving motor a predetermined time before the leading edge of the image region arrives at a reference position.

3. The apparatus of claim 2, wherein when the clutch engages the sleeve and the driving motor, the driving motor is rotated at a low speed.

4. The apparatus of claim 3, wherein the rotational speed of the driving motor is raised gradually to the rated speed before the leading edge of the image region arrives at the reference position.

* * * * *